United States Patent [19]

Dornbracht et al.

[11] Patent Number: 4,678,207

[45] Date of Patent: Jul. 7, 1987

[54] CONNECTOR ASSEMBLY FOR A WATER-DISPENSING FIXTURE

[75] Inventors: Helmut Dornbracht; Klaus-Peter Grasse, both of Iserlohn, Fed. Rep. of Germany

[73] Assignee: Aloys F. Dornbracht GmbH & Co., Iserlohn, Fed. Rep. of Germany

[21] Appl. No.: 814,108

[22] Filed: Dec. 27, 1985

[30] Foreign Application Priority Data

Dec. 29, 1984 [DE] Fed. Rep. of Germany ..... 3447802

[51] Int. Cl.[4] ..... F16L 55/00

[52] U.S. Cl. ..... 285/39; 285/46; 285/161

[58] Field of Search ..... 285/23, 39, 46, 161

[56] References Cited

U.S. PATENT DOCUMENTS

| | | | |
|---|---|---|---|
| 1,730,455 | 10/1929 | Glauber | 285/46 X |
| 3,105,707 | 10/1963 | Jacobson | 285/39 |
| 3,556,566 | 1/1971 | Bromberg et al. | 285/162 |

FOREIGN PATENT DOCUMENTS

| | | |
|---|---|---|
| 1724274 | 2/1956 | Fed. Rep. of Germany . |
| 1232413 | 1/1967 | Fed. Rep. of Germany . |
| 7207371 | 5/1972 | Fed. Rep. of Germany . |
| 7406676 | 7/1974 | Fed. Rep. of Germany . |
| 414484 | 12/1966 | Switzerland . |

*Primary Examiner*—Richard J. Scanlan, Jr.

*Attorney, Agent, or Firm*—Karl F. Ross; Herbert Dubno

[57] ABSTRACT

A nut or a pair of nuts connecting the inlet fitting or a pair of inlet fittings of a water-dispensing fixture to respective connecting fittings is axially aligned with a collar threaded onto each connecting fitting and bearing upon a wall from which the connecting fitting emerges. An apron is axially shiftable on the cylindrical surfaces of the nut and collar which are axially aligned and of the same diameter to completely cover the nut or nuts. The apron is held in place by an elastic member seated in the collar.

10 Claims, 5 Drawing Figures

CONNECTOR ASSEMBLY FOR A WATER-DISPENSING FIXTURE

FIELD OF THE INVENTION

The present invention relates to a connector assembly for a water discharge fixture, e.g. a faucet or faucet assembly, which is adapted to be mounted on a wall through which the water is fed to the fixture.

BACKGROUND OF THE INVENTION

It is known to provide water-discharge fixtures, e.g. faucets, having one or more valves and respective inlet fittings for controlling water flow and one or more spigots through which the water is discharged, with a connector assembly which enables a nipple of the, or each, valve to be connected to an offset pipe fitting, also referred to as an S-connector, or other means providing water supply to the fitting.

It is not uncommon to provide the nipple with a nut which is threaded onto a male threaded portion of the S-connector or offset connector so as to clamp the end of the nipple against the end of the connector via a seal, e.g. an elastomeric washer which is interposed between the two. The opposite male threaded end of the S-connector is designed to be connected to the water supply piping, e.g. by a compression fitting or some other threaded pipe fitting structure.

In Swiss Pat. No. 414,484, such a connecting assembly is described in which there is also threaded onto an offset fitting or S-fitting, a collar or apron which encloses at least part of the offset fitting and thus provides a more pleasing appearance for the connector assembly where it emerges from the wall. This arrangement is used primarily in shower or bathroom fixture mountings.

One of the problems with the assembly shown in this patent, however, is that the collar which is used to conceal the offset fitting and thus to improve the appearance, does not cover the nut which must be provided with surfaces, e.g. flats enabling engagement by a wrench, key or the like and this, of course, leaves these surfaces exposed.

OBJECTS OF THE INVENTION

It is the principal object of the present invention to provide an improved connector assembly which eliminates these drawbacks and other disadvantages of the prior art and allows a collar to brace the offset fitting against the wall and to be threaded onto the same end to which the fixture is coupled to the offset fitting, while nevertheless providing a pleasing appearance of the connector assembly between the fixture and the wall.

Another object of this invention is to provide an improved connector assembly between a water-dispensing fixture and a wall through which the fixture is connected to the water supply by an offset fitting and in which the offset fitting is effectively concealed.

Still another object of the invention is to provide a simple, economical and effective connection assembly for the purposes described wherein space between the fixture and the wall is substantially bridged by an apron concealing the interior parts of the connection assembly completely.

SUMMARY OF THE INVENTION

These objects and others which will become apparent hereinafter, are attained, in accordance with the present invention, in a connection assembly between a water-dispensing fixture having an inlet fitting and an offset, S-shaped or other connecting fitting projecting from a wall and which comprises a nut for coupling the inlet fitting to a threaded end of the connecting fitting, a collar surrounding the connecting fitting, and threaded onto this end in axial alignment with the nut and adapted to be braced against the wall upon threaded displacement along this end of the connecting fitting, and an apron.

According to the invention, the nut and collar have two coaxial surfaces conforming to right-circular cylinders of the same diameter and the apron is guided on these surfaces axially between a position in which the nut is accessible to allow the interconnection of the fittings and a position in which the apron covers the gap between the nut and the collar in the finished position of the apron and is retained there by retaining means. In the latter position, the or each nut is fully covered by the apron.

According to the invention, therefore, the nut and the collar each have a circularly cylindrical outlet surface and are coaxial with one another, having the same diameter so that their respective outer surfaces form right circular cylindrical guide surfaces for the apron.

The apron which can be a right-circular cylindrical sleeve which is likewise coaxial with the surfaces or can extend over the connector nuts and collars of two water inlets, has an axial length which is shorter than the total axial length of the collar and nut. Advantageously, the apron has an axial length which exceeds to at least a certain extent the axial length of the nut when it has been tightened. The length excess of the apron is sufficient in each case to bridge the gap or the abutment zone between the nut and the collar.

When it is desired, therefore, to remove the fixture, the apron is shifted onto the collar so as to make the nut accessible. However, when the finished position of the apron is desired, the apron can be shifted onto the nut so as to define a smooth surface around the nut so that the secantral facets or flats of the nut which are provided for engagement with the wrench will no longer be accessible or even visible.

In the case of a single inlet, where the apron is a cylindrical sleeve, the collar may be formed with a smooth cylindrical surface in the portion exposed when the sleeve completely covers the nut.

For remounting of the fixture, or its replacement by a new fixture, the nut is tightened into place and the sleeve then moved over the nut so that the nut is completely concealed and the aforementioned gap between collar and nut is completely concealed.

The connecting assembly of the invention has been found to be especially advantageous in conjunction with S-shaped or offset connecting fittings, especially for large volume water-dispensing fixtures such as bathtub and shower fixtures.

The apron can by cylindrical as noted, or can be formed with part cylindrical surfaces and in any case can be formed as a structure sliding on the cylindrical surfaces of each nut and the collar coaxially aligned therewith so that linear contact is provided between the apron and the cylindrical guide surfaced noted. Where the apron is substantially a rectangular parallelopiped, the surfaces of the apron may be tangent to the circularly cylindirical surfaces of the aligned nut and collar or each aligned nut or collar. Consequently, the surface of the apron is cylindrical in the broadest definition of this word, i.e. defined by the movement of a generatrix parallel to the axis about the axis in a closed path around the axis.

The means for arresting the slidable apron is best provided, according to the invention, by a resilient sealing ring or other member received in a groove in the periphery of the collar or nut close to the junction and thus at a portion bridged by the excess axial length of the sleeve as noted. The entropy-elastic sealing ring not only provides a seal along the inner periphery of the apron but also acts as an elastic member retaining the apron in the positions in which it is slid.

Mention may be made of U.S. Pat. No. 2,846,691 which does disclose a structure having two fittings in the manner previously described, but there is no equivalent to the axially slidable member of the invention in that system in conjunction with a pair of threaded collars.

According to another feature of the invention, the apron forms one member of a pair of telescoping aprons which are interfitted, the other apron being axially slidable in the manner described while the other apron, which in place is stationary and can be located between a shoulder of the collar of each of the two fittings and the wall, completely filling the space between the movable apron member and the wall.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
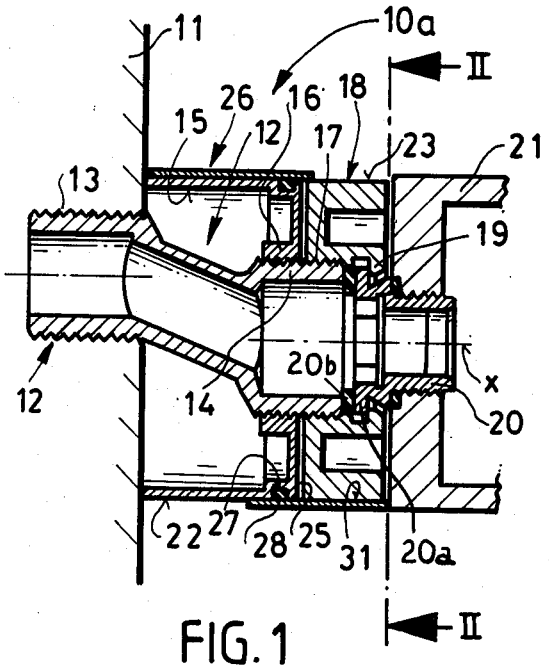
FIG. 1 is an axial section through a single-fitting connecting assembly for a water-dispensing fixture according to the invention only part of the fixture being visible.
Figure 2:
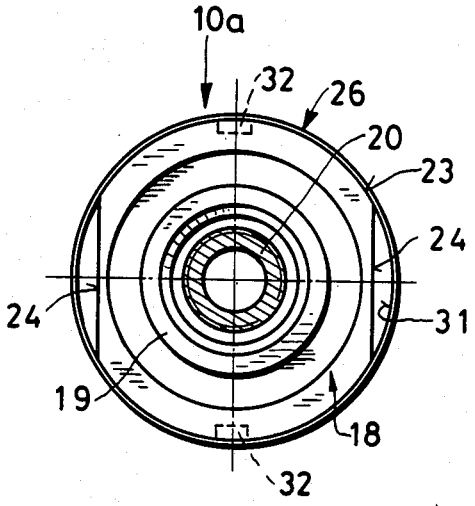
FIG. 2 is a section taken along line II—II of FIG. 1.

FIGS. 1 and 2 show only the rear side 21 of a water-dispensing fixture and even this is shown in highly diagrammatic form. The connecting assembly of the invention is represented at 10*a* in FIGS. 1 and 2 and at 10*b* in FIGS. 3 through 5. For convenience, identical elements or identically functioning elements for all embodiments have been designated with the same or similar reference characters.

Figure 3:
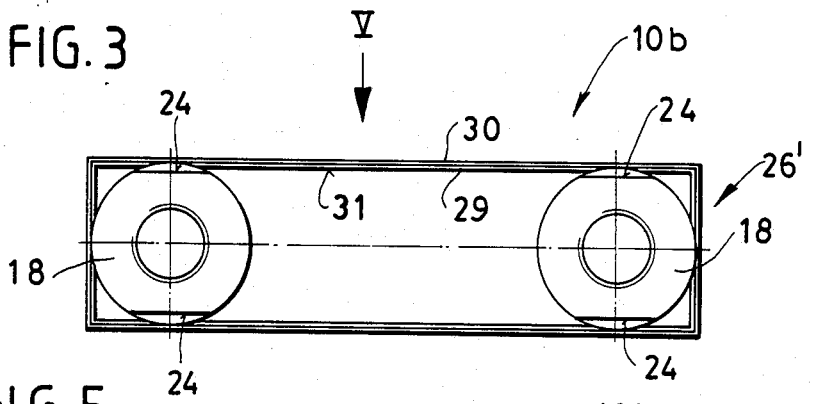
FIG. 3 is a view similar to FIG. 2 but illustrating an assembly having two sets of nuts and collars for a double-inlet fixture.
Figure 5:
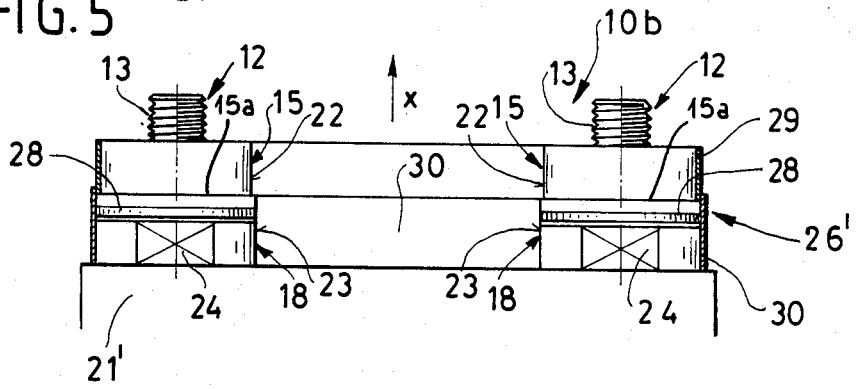
FIG. 5 is a view in the direction of arrow V in FIG. 3 or FIG. 4 with the apron therein broken away.
Figure 4:
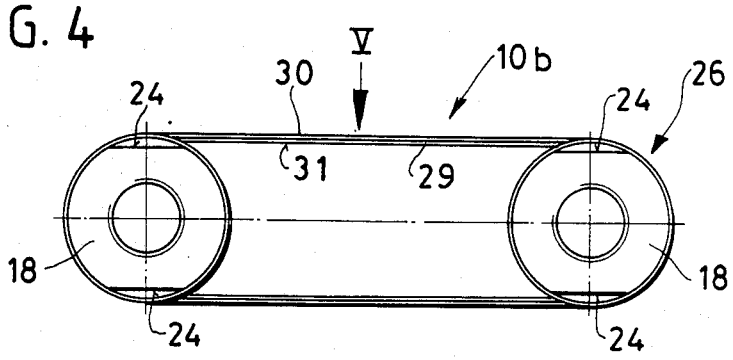
FIG. 4 is a view similar to FIG. 3 but illustrating another embodiment, i.e. an embodiment in which the aprons have a different shape.

The wall 11 of the building is traversed by an offset or S-fitting 12 (connecting fitting) which has two threaded ends 13 and 14, the former of which can be connected to the water supply line by a compression fitting or other pipe fitting threaded onto the connection fitting 12 or into which the connecting fitting is threaded. The offset or S-shape allows adjustment of the spacing of the threaded ends 14 of, say, two connecting fittings 12 (e.g. as in the embodiments of FIGS. 3 through 5) to the center-to-center spacing of nipples 20 constituting inlet fittings of the fixture 21. In the embodiment illustrated in FIGS. 1 and 2, the fixture 21 has only a single water inlet fitting 20 while the fixture 21' of the FIGS. 3 through 5 is shown to have two water inlet fittings.

The connecting assembly 10*a* comprises a collar 15 having an internally threaded boss 16 which is threaded onto the second male threaded end 14 of the connecting fitting 12 and can brace against the wall 11. Coaxial with this collar 15 is a nut 18 which has an inwardly extending rib 19 lodged behind an outwardly extending flange 20*a* of the inlet fitting 20 and which, when threaded onto the end 14 of the connecting fitting 12, compresses a washer 20*b* against the end of the fitting 12 to effect a water-tight junction between them.

Both the collar 15 and the nut 18 have circularly cylindrical outer surfaces 22 and 23, respectively, the cylindrical surface 23 being interrupted by only two secantral parallel surfaces 24 which are planar and can enable the nut to be engaged by a wrench.

Instead of the planar surfaces 24, the nut 18 can be formed with holes for engagement by a spanner or pin wrench or other tool enabling tightening of the latter.

The surfaces 22 and 23 are of the same diameter, are coaxial with one another and are flush with one another except for a gap or junction 25 formed between the nut and the collar.

In the embodiment of FIGS. 1 and 2, a circularly cylindrical sleeve 26 forming an apron slidable upon but close fitting against the outer surfaces 22,23, is provided.

The axial length (i.e. the length in the direction of the axis x) of the apron 26 is so selected that, as can be seen in the lower part of FIG. 1, the outer surface of the nut is completely concealed and the apron extends over the gap 25 when the apron is shifted to the right against the fixture 21. In this position it is held against undesired movement by an O-ring 28 received in peripheral groove 27 in the collar 15 close to the gap 25. The O-ring 28 projects sufficiently in its expanded state so that it is radially compressed by the apron and bears frictionally against the latter to arrest the apron in its respective axial position while sealing the apron with respect to the collar.

When apron 26 is shifted to the left as represented in the upper portion of FIG. 1, the surfaces 24 of the nut are exposed and if not can be tightened or loosened being accessible to a wrench.

In addition, or alternatively, either the nut or the collar can be provided with radial blind bores 32 in which resilient studs can be received, e.g. rubber studs, to bear frictionally against the inner surface of the apron and retain it in place.

The connecting assembly of 10*b* of FIGS. 3 through 5 has two fittings 20 on the fixture and hence two sets of nuts and collars 15, 18, similar in construction to those described in connection with FIGS. 1 and 2. Here however, the apron 26' can include two telescoping members 29 and 30, the first being lodged between a shoulder 15*a* of each collar and the wall 11. The thickness of the member 29 is equal to the height of the collar shoulder.

The second member 30 is slidable upon but close fitting with respect to the member 29 and has an axial length in excess of that of the nuts 18.

The members 29 and 30 are elongated-section tubular structures but have parallel sides 31 so that they are essentially rectangular parallelopipeds (FIG. 3) or rectangular parallelopipeds with semi-cylindrical ends (FIG. 4).

As can be seen from FIG. 5, the partial apron 30 extends axially past the end of the nuts 18 to cover the flats 24 of the nuts 20 and is held in place by frictional engagement with the O-rings 28 seated in grooves of the collars 15.

In the event the flats 24 are to be exposed to allow engagement by a wrench, the partial apron 30 is shifted upwardly in the view seen in FIG. 5 to cover the other partial apron 29. As in the embodiment of FIGS. 1 and 2, here the nuts and collars have a combined axial length in excess of the axial length of the movable apron part 30.

The only difference between the embodiment of FIGS. 3 and 4 is in the shape of the apron parts.

In FIG. 3 the prismatic or parallelopipedal movable apron part slides along the flush cylindrical surfaces of the nut and collar with only linear contact because the surfaces of the movable apron part are tangential to the cylindrical surfaces.

In FIG. 4, however, the movable apron part has semicylindrical surfaces at its ends which ride upon the cylindrical surfaces of the nuts and collars with semicylindrical surface contact therewith.

The stationary apron part 29 can be omitted when the space between the nut/collar assemblies for each fitting in the embodiments of FIGS. 3 through 5 is filled by a hollow or massive spacer having semicylindrical concave surfaces engaging the nut/collar pairs from between the two pairs.

We claim:

1. A connector assembly for a water-dispensing fixture wherein at least one connecting fitting is to be joined to an inlet fitting of said fixture, said assembly comprising:

a collar threaded onto an end of said connecting fitting and adapted to bear upon a wall around said connecting fitting;

a nut threaded onto said end of said connecting fitting for joining said inlet fitting thereto, said nut having flats enabling the engagement thereof by a wrench, said nut and said collar having axially aligned cylindrical surfaces of the same diameter;

an apron axially shiftable on said nut and said collar and having a surface close fitting to said cylindrical surfaces and of an axial length greater than that of said nut and less than the total length of said nut and said collar, whereby said apron can be shifted axially in one direction on said cylindrical surfaces to expose said flats and in the opposite axial direction to completely cover said nut; and means for retaining said apron relative to said nut at least in a position of said apron in which said nut is covered by said apron.

2. The connecting assembly defined in claim 1 wherein said retaining means includes at least one elastic member frictionally engaging said apron and retaining it in position over said nut.

3. The connecting assembly defined in claim 2 wherein said member is a stud of elastic material received in a radial bore formed in one of said nut and collar.

4. The connecting assembly defined in claim 2 wherein said member is an O-ring received in a circumferential groove formed in one of said nut and said collar.

5. The connecting assembly defined in claim 4 wherein said groove is formed in said collar adjacent said nut.

6. The connecting assembly defined in claim 1 wherein said apron is formed from two telescoping parts.

7. The connecting assembly defined in claim 1 wherein said fixture is provided with two spaced-apart inlet fittings and each of said inlet fittings is connected to a respective connecting fitting by a respective such nut axially aligned with a respective collar and said apron covers both of said nuts.

8. The connecting assembly defined in claim 1 wherein said apron has the configuration of a right circular cylinder.

9. The connecting assembly defined in claim 7 wherein said apron has generally a polygonal configuration and tangentially engages cylindrical surfaces of both nuts and collars.

10. The connecting assembly defined in claim 1 wherein said apron is generally of polygonal configuration and tangentially engages said cylindrical surfaces.

* * * * *